US011659898B2

(12) United States Patent
Chan

(10) Patent No.: US 11,659,898 B2
(45) Date of Patent: May 30, 2023

(54) SECURING DEVICE WITH SPRING CLOSURE

(71) Applicant: Duraflex Hong Kong Limited, Hong Kong (CN)

(72) Inventor: Yick Fai Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 38 days.

(21) Appl. No.: 17/555,870

(22) Filed: Dec. 20, 2021

(65) Prior Publication Data

US 2023/0119434 A1 Apr. 20, 2023

Related U.S. Application Data

(63) Continuation-in-part of application No. 17/503,608, filed on Oct. 18, 2021, now Pat. No. 11,439,208.

(51) Int. Cl.
*A44B 13/02* (2006.01)

(52) U.S. Cl.
CPC ..... *A44B 13/02* (2013.01)

(58) Field of Classification Search
CPC ..... A44B 11/2526; A44B 11/2546; A44B 11/005; A44B 11/16; A44B 11/00; A44B 11/04; A44B 13/02; A45C 13/14; A41F 1/008; A41F 15/02; A41F 15/002; A41F 15/00; Y10T 24/4088; Y10T 24/4093; Y10T 24/45319
See application file for complete search history.

(56) References Cited

U.S. PATENT DOCUMENTS

| | | | | |
|---|---|---|---|---|
| 2,212,862 | A | 8/1940 | Hirsh | |
| 5,177,837 | A | 1/1993 | Rekuc | |
| 5,432,985 | A | 7/1995 | Bernart | |
| 9,560,909 | B2 | 2/2017 | Krpan | |
| 10,779,581 | B2 * | 9/2020 | Molina | A41C 3/00 |
| 2005/0108860 | A1 * | 5/2005 | Crane | F16G 17/00 24/329 |
| 2008/0022498 | A1 * | 1/2008 | Griffith | F16B 45/02 24/598.7 |

* cited by examiner

*Primary Examiner* — Robert Sandy
*Assistant Examiner* — Rowland Do
(74) *Attorney, Agent, or Firm* — Collard & Roe, P.C.

(57) ABSTRACT

A securing device has a main body having a first side wall, a second side wall, and at least one first slot for receiving a strap, and a top bar connected to the main buckle body at the first side wall and forming a second slot with the main buckle body for receiving a second strap. The second slot is open at a distal end thereof. The top bar has a guide track extending longitudinally therethrough, with the guide track opening into the second slot. A catch is formed on the second side wall and facing inward. A spring gate is disposed in the guide track. The spring gate is placed around the catch to close the distal end of the second slot. The spring gate is releasable from the catch by pressing on the top bar until the spring gate clears the catch.

12 Claims, 9 Drawing Sheets

SECURING DEVICE WITH SPRING CLOSURE

CROSS-REFERENCE TO RELATED APPLICATIONS

This application is a continuation-in-part of U.S. patent application Ser. No. 17/503,608, filed on Oct. 18, 2021, the disclosure of which is herein incorporated by reference.

BACKGROUND OF THE INVENTION

1. Field of the Invention

This invention relates to a device that allows for releasable connection of a strap to a device or to another strap. In particular, the invention relates to a device that allows for simple and quick attachment and detachment of a loop of a strap to the device, via the use of a spring closure system.

2. The Prior Art

Buckles with spring gate closure systems have been used to attach straps, particularly straps with closed loop ends, to the buckle in a releasable manner. These types of buckles are used when the removal of the strap may be necessary, or can be used as replacement buckles for a broken buckle in which the strap is already sewn in place. The top bar of the buckle has a free end so as to formed an open slot, and is closed via a separate spring gate locking element that is inserted through a hole or holes in the end of the top bar. The locking element is then pressed into position so that it extends around a catch on the buckle body, thus closing the open slot and keeping the strap connected to the buckle. The drawback of this design is that the spring gate locking element, which is generally formed by a wire that is bent into an L-shape at its end to insert through the holes, is not stable under high forces, as the wire can bend, causing the ends to slip out of the holes and release the strap. Furthermore, the spring gate locking element in this design must be bent out of its original shape in order to be inserted into the holes of the buckle, which further destabilizes the design.

SUMMARY OF THE INVENTION

It is therefore an object of the invention to provide a buckle or other securing device for attaching a strap, in which the locking element cannot be inadvertently removed from the securing device during use and under high forces on the securing device. It is another object of the invention to provide a securing device in which the locking element can be assembled with the securing device in a simple manner without deforming the locking element.

These and other objects are accomplished in one embodiment by a buckle comprising a main buckle body having a first side wall, a second side wall, and at least one first slot for receiving a strap, and a top bar connected to the main buckle body at the first side wall and forming a second slot with the main buckle body for receiving a second strap. The second slot is open at a distal end thereof. The top bar has a guide track extending longitudinally therethrough, with the guide track opening into the second slot. The guide track extends parallel to the second slot. A catch is formed on the second side wall adjacent the distal end of the second slot. A spring gate in the shape of a loop with overlapping end portions is disposed in the guide track. The spring gate is configured to be placed around the catch to close the distal end of the second slot. The spring gate is releasable from the catch by pressing on the top bar until the spring gate clears the catch. The spring gate is attachable to the top bar by sliding the spring gate into the guide track from the second slot and moving the spring gate to the distal end of the top bar. The guide track preferably opens into the second slot at an oblique angle. This enables the spring gate to be assembled with the guide track simple and easily.

There is at least one protrusion extending into the guide track at the distal end of the guide track to keep the spring gate at the distal end of the guide track once it clears the protrusion. By assembling the spring gate to the buckle in this way, the spring gate does not have to be bent or deformed in any way in order for it to be attached to the buckle. The spring gate is placed onto the catch by rotating the gate around until it rests under the catch, which is preferably in the form of a downward-facing hook. The pressure created by pressing on the spring gate deforms the spring, as it cannot move within the guide track due to the protrusion blocking the guide track. The spring then stores a restoring force that helps to remove the spring from the catch once the top bar is pressed downward sufficiently to release the spring gate from the catch.

The connection between the spring gate and the catch prevents any straps inserted into the second slot from sliding out of the buckle through the open end.

The spring gate is preferably formed from a metal wire that is bent into a loop with overlapping end portions. Each of end portions of the spring gate have extensions that extend perpendicular to a circumferential direction of the spring gate and in opposite directions to each other, so as to form an essentially Z-shaped profile. These extensions serve to anchor the spring gate in the guide track when the buckle is subject to force from straps being pulled. To receive the extensions, the top bar contains grooves in communication with the guide track, which receive the extensions of the spring gate when the spring gate is positioned at the distal end of the guide track. Force on the top bar away from the main body presses the extensions deeper into the grooves to prevent the spring gate from opening. Furthermore, this pressure from a strap presses on the top bar to compress the guide track and further anchor the spring gate in place.

There is preferably a reinforcing protrusion on a bottom surface of the guide track at an opposite end of the protrusion, so that excessive force on the top bar does not damage the portion below the guide track.

In an alternative embodiment, the invention can take the form of a closed loop securing device such as a D-ring or triangular shaped ring having a spring gate closure. In this embodiment, the securing device is formed by main body having a first side wall, and a second side wall, and a top section connected to the main body at the first side wall. A gap is formed between a distal end of the top section and the second side wall. The top section has a guide track extending longitudinally therethrough and having an opening to a space outside the top section. A hook is formed on the second side wall facing the first side wall. As with the embodiment discussed above, the spring gate is in the shape of a loop with overlapping end portions and is configured to be assembled with the main body by inserting the spring gate in the guide track and sliding the spring gate to the distal end of the guide track. The spring gate is configured to snap into the hook in a resting position to close the gap between the second side wall and the top bar, and wherein the gap is opened by pressing the spring gate inward to release the spring gate from the hook. The difference between the arrangement of the D ring in this embodiment, and the first embodiment described above, is that here, the hook is facing the interior of the main body and the spring gate rotates inwardly in order to allow access to the main body for attachment of articles to the D-ring. In this embodiment the spring gate is disposed in the hook in a resting position, so that the ring is kept in the closed position until forces are applied to move the spring gate inward to allow access to the ring.

The top section of the securing device further comprises a slot for receiving a strap. The slot has an opening to a space between the side walls. The guide track connects to the slot at an oblique angle to a longitudinal extension of the guide track. There is at least one protrusion extending into the guide track at the distal end of the guide track to keep the spring gate at the distal end of the guide track. There is also a reinforcing protrusion extending into the guide track at an opposite end of the guide track from the first protrusion.

As with the spring gate of the first embodiment, the end portions of the spring gate have extensions that extend perpendicular to a circumferential direction of the spring gate and in opposite directions to each other. The top section of the securing device contains grooves in communication with the guide track. The grooves are configured to receive the extensions of the spring gate when the spring gate is positioned at the distal end of the guide track, such that force on the top section away from the main body presses the extensions deeper into the grooves to prevent the spring gate from opening.

A strap can be connected to the securing device by placing the strap through the slot and around the top section. Tension on the strap away from the main body presses the strap against the top section and compresses the guide track. The spring gate is formed from metal wire but could also be made of any other suitable material.

In a further embodiment, the device is in the form of a carabiner clip instead of a ring, taking on a more rounded elongated shape in the main body, but retaining all of the functional features described above with respect to the ring. In this embodiment, clip has a first side wall, a second side wall and a top section separated from the second side wall by a gap. The top section of the carabiner clip further comprises a strap retainer pivotably connect to the top section. The strap retainer is in the form of a closed loop with a central slot for receiving a strap. The strap retainer can be mounted on post extending form the top section of the clip to allow rotation of the strap retainer around the post.

In this embodiment, since the top section of the carabiner is not as wide as the ring previously described, the guide track can assume a curved shape, extending down the first side wall of the carabiner clip. In this embodiment, the guide track can be formed by a top bar extending toward the first side wall and a support bar extending from the first side wall toward the opening and parallel to the top bar. A space between the top bar and the support bar opens into the guide track to allow assembly of the spring gate into the guide track. This embodiment follows all of the other features of the ring-like securing device described above.

The present invention has the distinct advantages over the prior gated buckles and securing devices, as the spring gate locking element of the present invention does not need to be deformed during assembly, and it cannot be inadvertently released due to large forces on a strap connected to the device. Furthermore, the gate is simple to assemble with the device, and does not require the formation or assembly with small holes in the device.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE EMBODIMENTS

Figure 1:
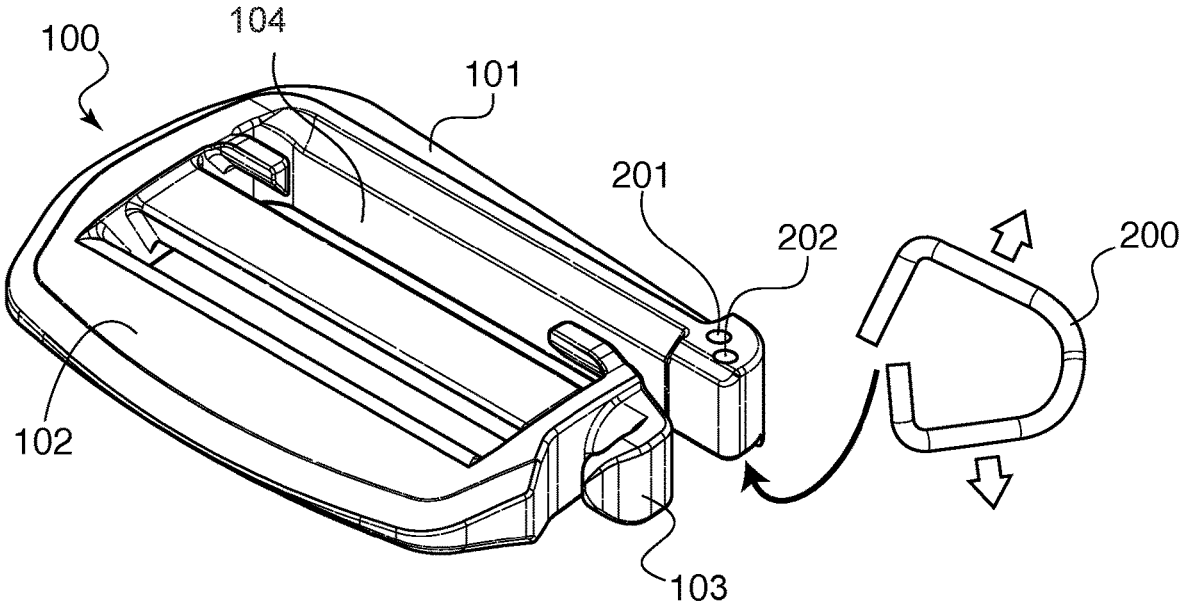
FIG. 1 ( Prior Art )
FIG. 1 shows a prior art buckle assembly.

Referring now in detail to the drawings, FIG. 1 shows a prior art buckle 100, which has a main body 102 connected to a top bar 101. A spring gate 200 is connected to the free end of top bar 101 by deforming the spring gate 200 until the ends are spaced apart enough to be inserted into holes 201 and 202 of top bar 101. Once spring gate 200 is connected to top bar 101, it can be used to close the opening into the slot 104, by hooking spring gate 200 around catch 103. The drawback to this design is that the deformation of the spring gate 200 leads to some unreliability of the spring gate, as it does not always snap back to its original shape once it is fully assembled onto top bar 101. Furthermore, vertical pressure such as from straps connected to the buckle and to top bar 101 can force the ends of the spring gate 200 to bend and slip out of the holes 201, 202, which can then lead to failure of the buckle and release of any attached straps.

Figure 2:
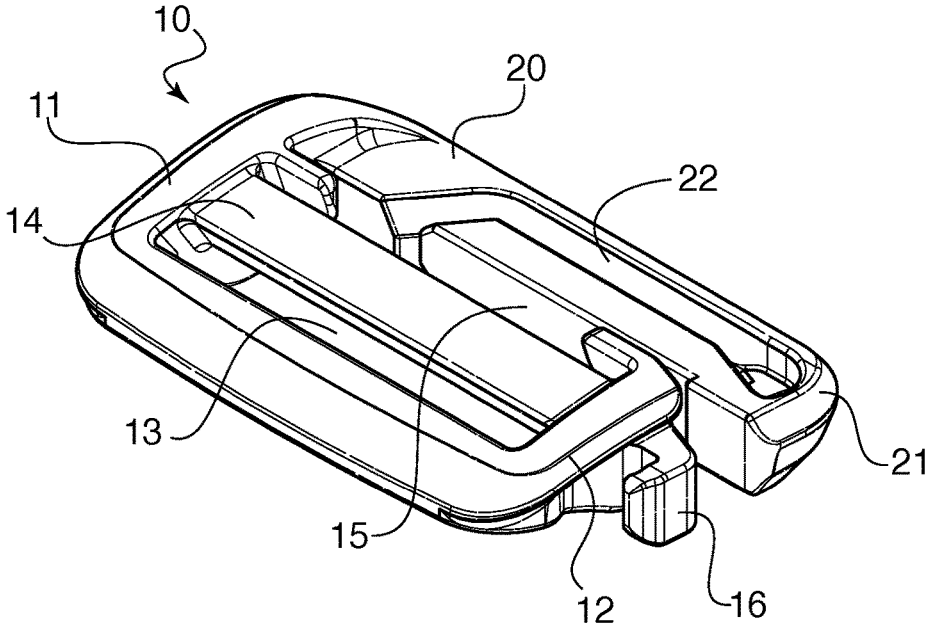
FIG. 2 shows a perspective view of the buckle according to the invention without the spring gate closure element.
Figure 3:
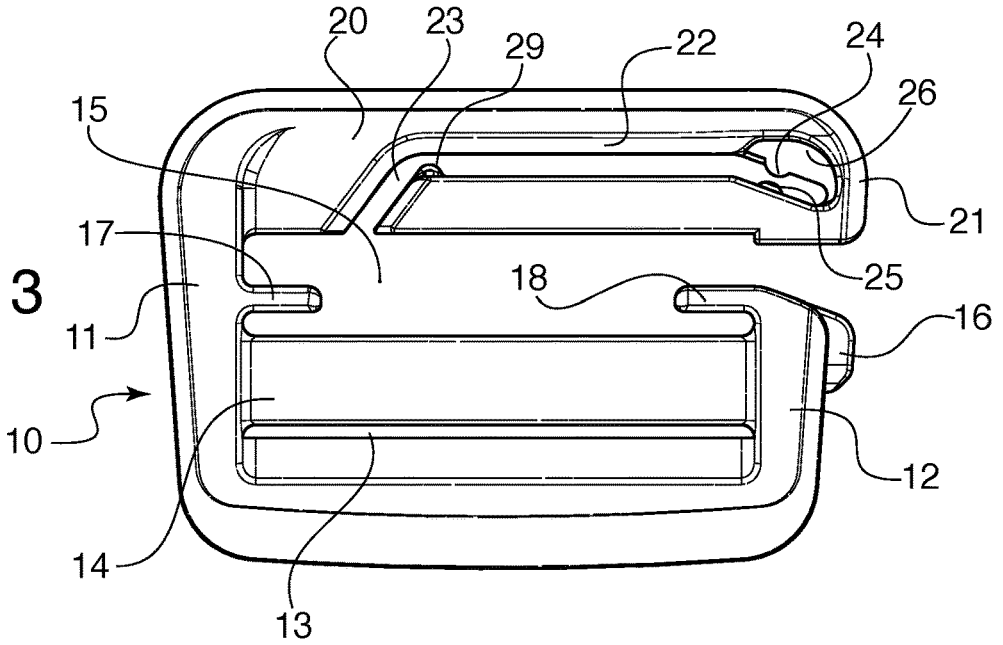
FIG. 3 shows another view of the buckle without the spring gate closure element.

The buckle of the present invention solves this problem through the use of a novel guide track in the top bar as well as a novel gate structure. The buckle of the present invention is shown in FIGS. 2-12. Here, as shown in FIGS. 2 and 3, buckle 10 has a main body consisting of side walls 11, 12 with a first slot 13 for receiving a strap. A central bar 14 spans first slot 13 and allows for strap adjustment as needed and arms 17, 18 keep the strap in place. Connected to side wall 11 is a top bar 20, which extends toward side wall 12 but is not connected to side wall 12. A second slot 15 is disposed between arms 17, 18 and top bar 20. Second slot 15 is open on its end adjacent side wall 12. A catch 16 in the form of a downward facing hook is disposed on side wall 12. Inside top bar 20 is a guide track 22 that runs parallel to the extent of top bar 20 and second slot 15. Guide track 22 is connected to second slot 15 by a guide slot 23, which is arranged at an oblique angle to guide track 22.

A lower protrusion 25 and an upper protrusion 24 are arranged at a distal end of the guide track, facing each other, to create an area of reduced width in guide track 22. A groove 26 is formed in top bar 20, which extends into guide track 22, which assists in holding spring gate 30, discussed below, in place. A corresponding groove is located on the opposite face of top bar 20 (not shown)

Figure 4:
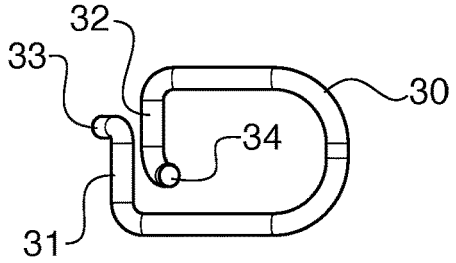
FIG. 4 shows a top view of the spring gate closure element.
Figure 5:
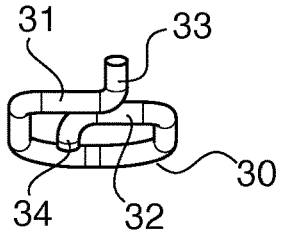
FIG. 5 shows a front view of the spring gate closure element.

FIGS. 4 and 5 show spring gate 30, which is formed of a metal wire or other elongated structure that is bent into a D-shape with overlapping end portions 31, 32. Each end portion 31, 32 has an extension 33, 34, respectively that extends perpendicular to the plane of spring gate 30, with each extension facing opposite the other, creating a Z-shaped profile.

Figure 6:
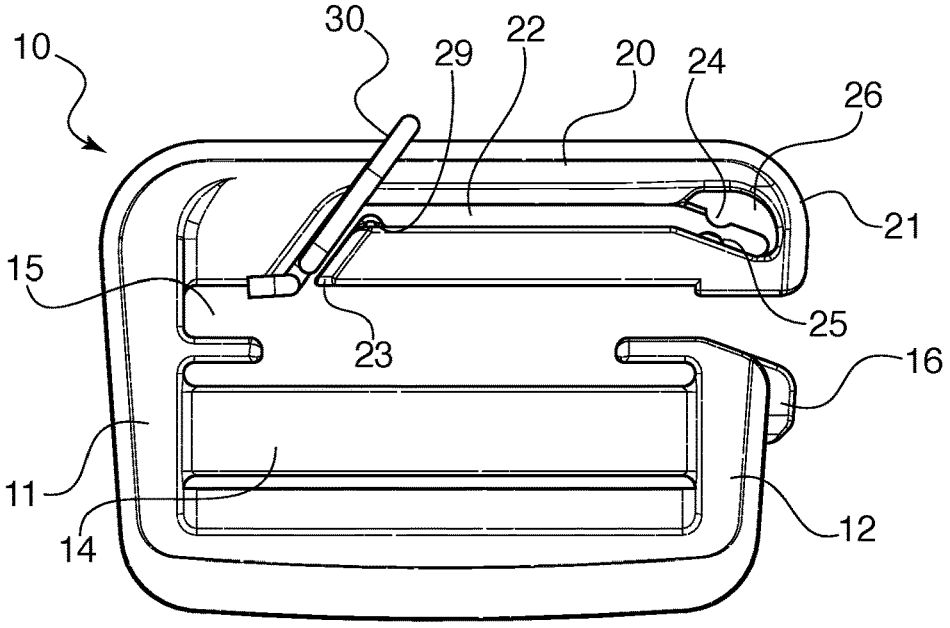
FIG. 6 shows the spring gate closure element being assembled into the guide track of the buckle.
Figure 7:
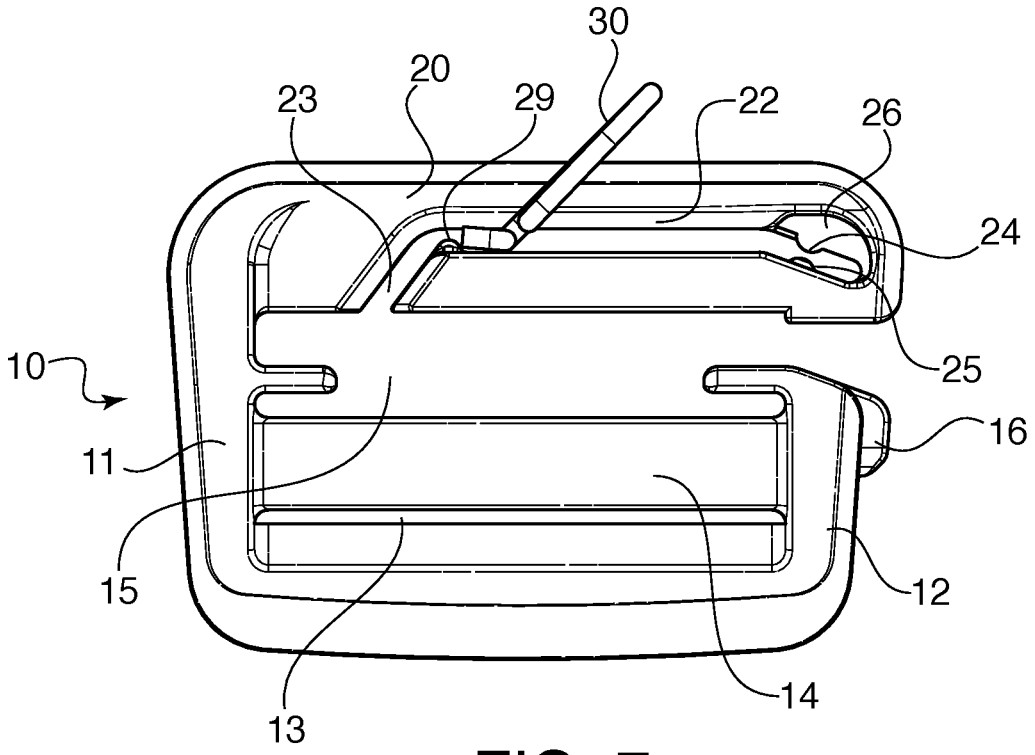
FIG. 7 shows the spring gate closure element moving along the guide track of the buckle toward the distal end.
Figure 8:
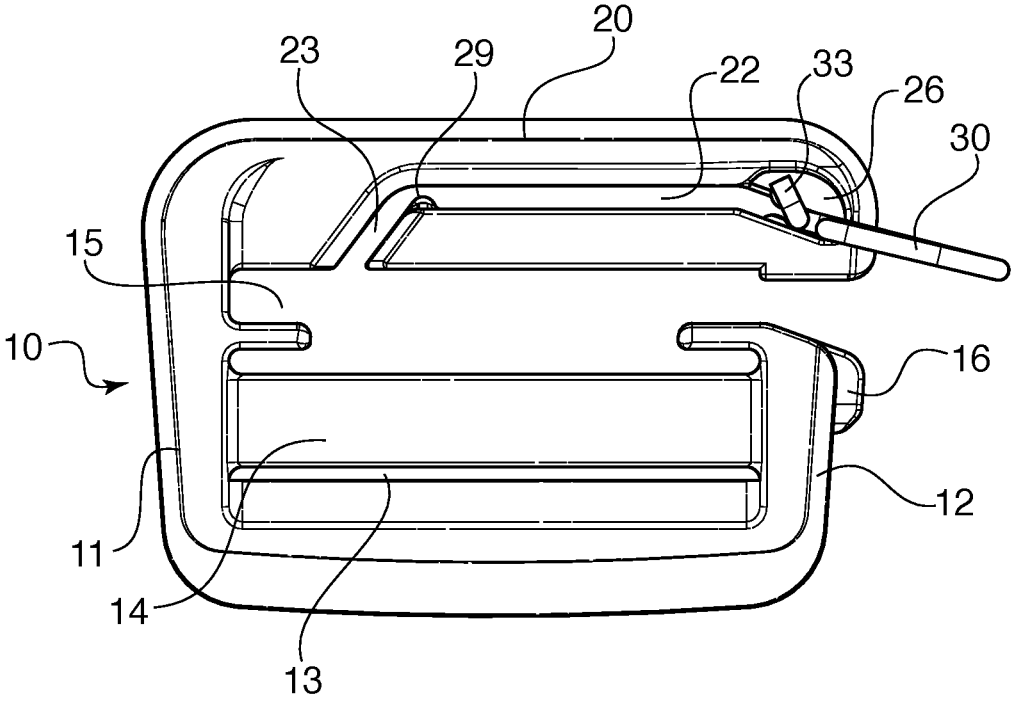
FIG. 8 shows the spring gate closure element in its assembled position in the guide track.

The assembly of spring gate 30 with buckle 10 is shown in FIGS. 6-9. As shown in FIG. 6, spring gate 30 is slid onto top bar 20 via open slot 15 and then fed into guide slot 23 and up into guide track 22. Spring gate 30 then slides along guide track 22 as shown in FIG. 7 until it reaches the distal end, at which it passes through protrusions 24, 25 under increased force, to reach the end of guide track 22, as shown in FIG. 8. Protrusions 24, 25 prevent spring gate 30 from sliding back along guide track 22 during use of the buckle 10. As shown in FIG. 8, extension 33 of spring gate 30 rests in groove 26 of top bar 20, and a corresponding groove 28 on the rear side of top bar 20 receives extension 34 as well.

Figure 9:
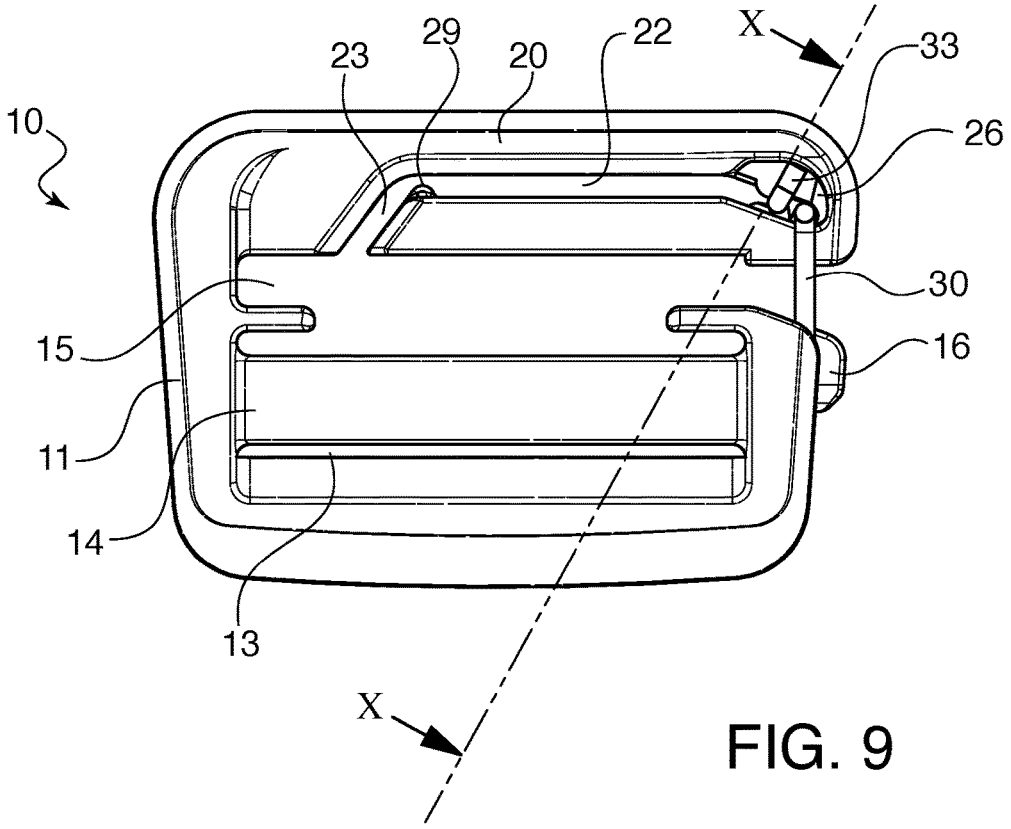
FIG. 9 shows the buckle in a locked position.
Figure 10:
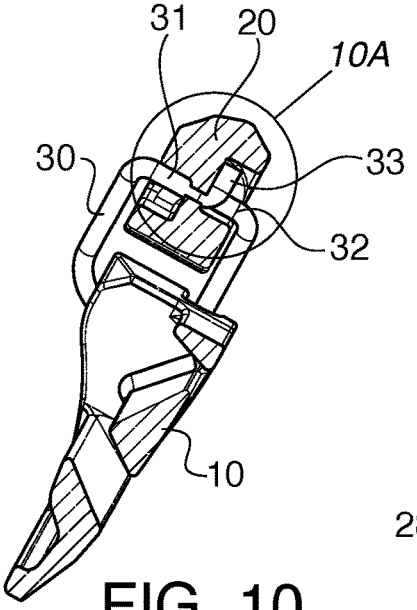
FIG. 10 shows a cross-sectional view along lines X-X of FIG. 9.
Figure 10A:
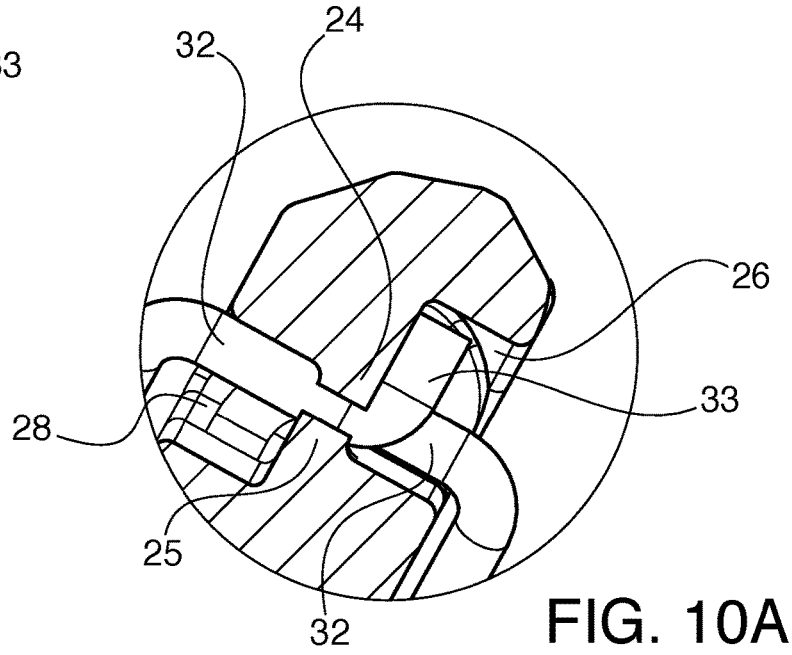
FIG. 10A shows an enlarged view of circle 10A of FIG. 10.

To lock buckle 10, spring gate 30 is rotated around top bar 20 until it passes over catch 16, at which time the hook on catch 16 locks spring gate 30 in place, as shown in FIG. 9. In the locked position, the extensions 33, 34 of spring gate 30 are pressed firmly against top bar 20 within grooves 26 and 28, preventing any movement of spring gate 30 during use, as can be seen in the cross-sectional views of FIGS. 10 and 10A.

Figure 11:
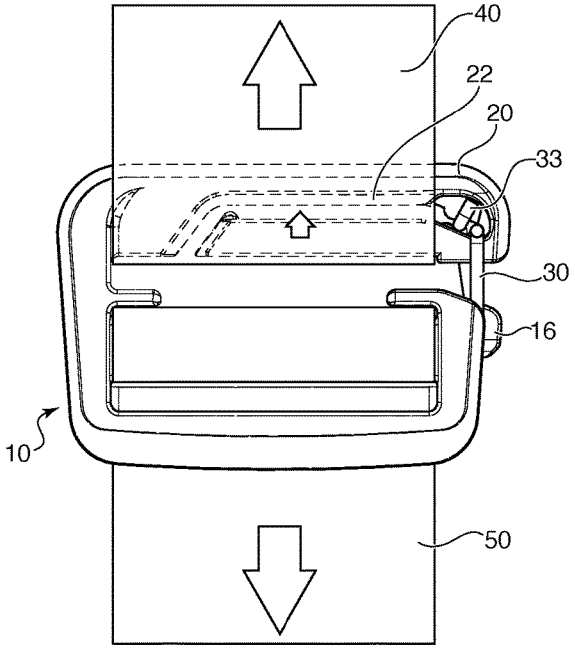
FIG. 11 shows the buckle having attached straps being pulled in opposite directions.

During use, strap 40 is looped around top bar 20 and strap 50 is threaded around central bar 14 in slot 13 as shown in FIG. 11 to connect two items together. When straps 40 and 50 are pulled in opposite directions along the arrows in FIG. 11, which is the typical case, the force of strap 40 on the underside of top bar 20 causes the underside of top bar 20 to bend slightly and compress guide track 22. This compression further secures spring gate 30 in place on buckled 10. To prevent excessive compression under heavy loads, an additional protrusion 29 can be supplied in guide track 22 adjacent guide slot 23, as shown for example in FIG. 9.

In addition to the compression of guide track 22, the upward force of the strap 40 on top bar 20 pulls on spring gate 30, which forces extensions 33, 34 of spring gate 30 even more tightly against top bar 20, so that inadvertent release of spring gate 30 from top bar 20 is prevented.

Figure 12:
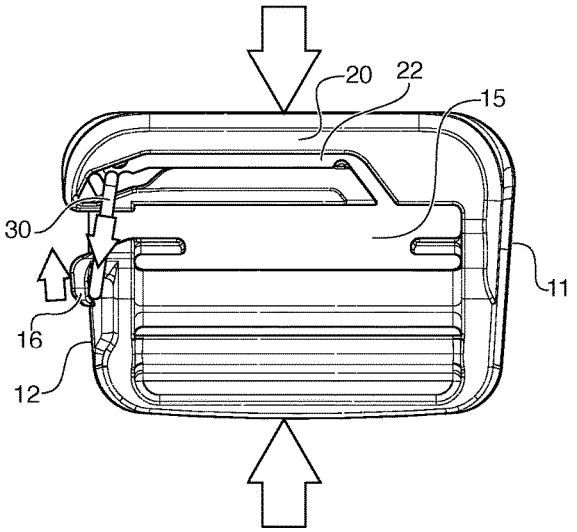
FIG. 12 shows the closure element being released from the catch by pressing down on the top bar of the buckle.

In order to release spring gate 30 from catch 16, the user simply presses down on top bar 30, as shown in FIG. 12, until spring gate 30 clears catch 16. The pressure of extensions 33, 34 against the walls of the grooves 26, 28 in top bar 20 creates a restoring force that allows spring gate 30 to then spring away from catch 16 to allow access to slot 15.

Figure 15:
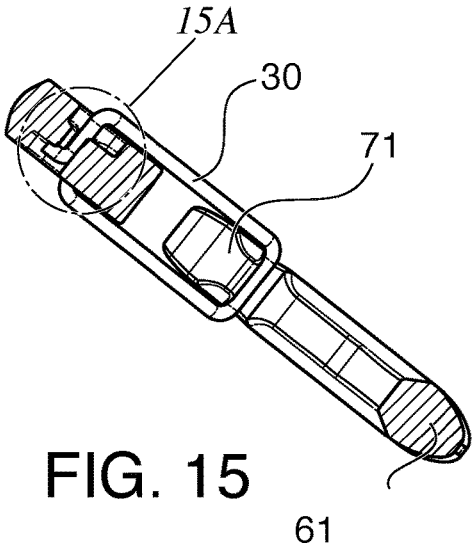
FIG. 15 shows a cross-sectional view along lines 15-15 of FIG. 14.
Figure 16:
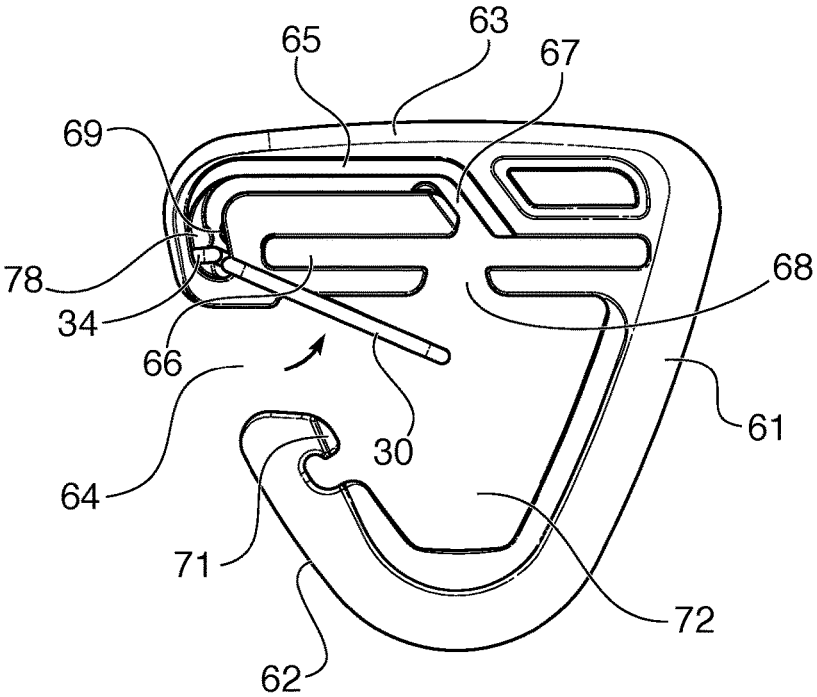
FIG. 16 shows the embodiment of FIG. 13 in an open position.
Figure 17:
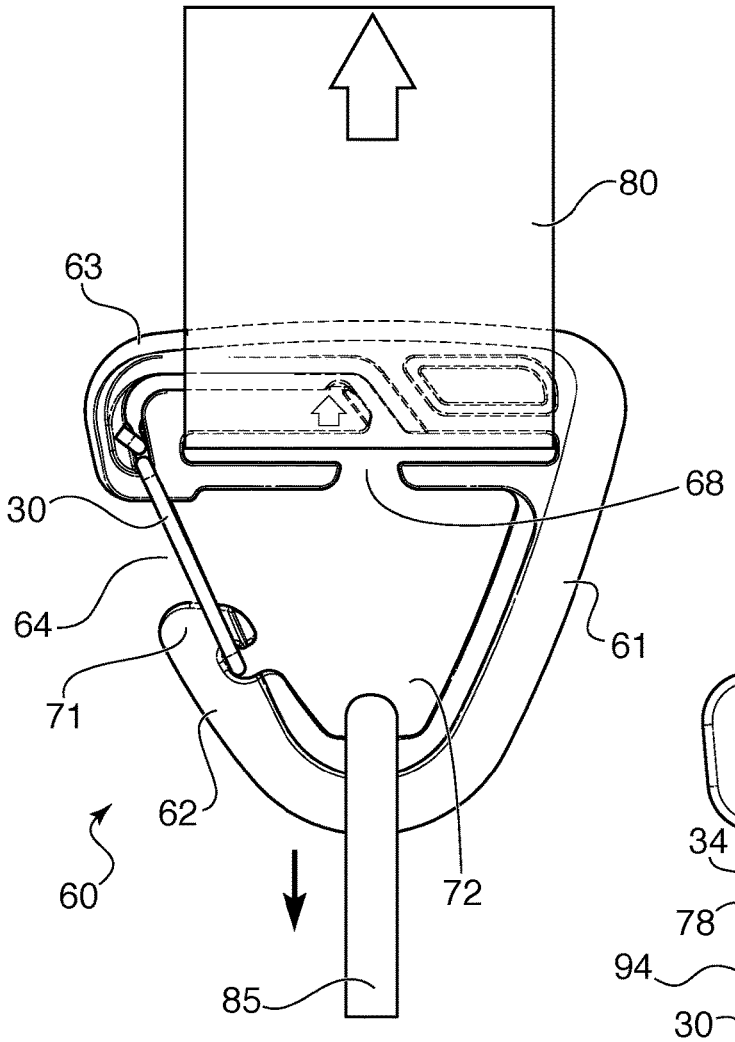
FIG. 17 shows the embodiment of FIG. 13 with a strap and accessory attached.

A first alternative embodiment of the invention is shown in FIGS. 13-17. Here, a securing device 60 in the form of a triangular shaped ring has a first side wall 61 connected to a second side wall 62 on one end and to a top section 63 on the other end. Top section 63 is separated from second side wall 62 by a gap 64. A hook 71 is disposed at the distal end of second side wall 62, adjacent the gap 64. Hook 71 faces inward toward a central cavity 72. A guide track 65 is disposed in top section 63, and extends into a slot 66 by way of a slanted guide slot 67. Slot 66 opens into the interior of device 60 via opening 68, to allow for attachment of a strap 80, such as shown in FIG. 17.

A protrusion 69 is arranged at a distal end of the guide track 65, create an area of reduced width in guide track 65. A groove 77 is formed in top section 63, which extends into guide track 65, which assists in holding spring gate 30 in place. Spring gate 30 is identical to spring gate 30 as described in FIGS. 4 and 5 above. A corresponding groove 78 is located on the opposite face of top section 63.

The assembly of spring gate 30 onto device 60 proceeds in the same manner shown in FIGS. 6-9. Spring gate 30 is slid into guide track 65 via opening 68 and then fed into guide slot 67 and up into guide track 65. Spring gate 30 then slides along guide track 65 until it reaches the distal end, at which it passes through protrusion 69 under increased force, to reach the end of guide track 65.

Figure 15A:
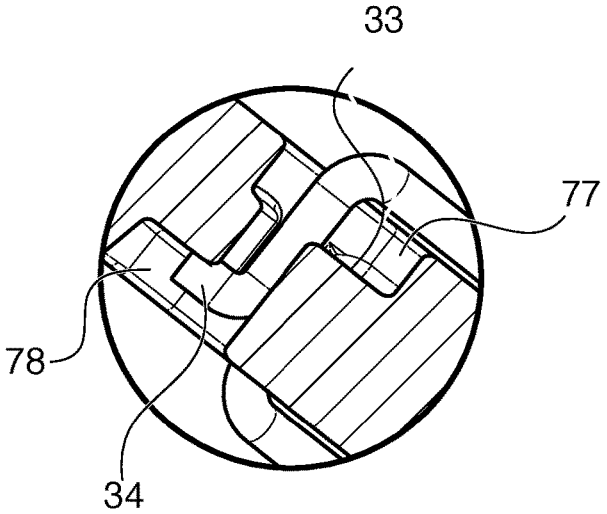
FIG. 15A shows a detail of circle 15A of FIG. 15.

Protrusion 69 prevents spring gate 30 from sliding back along guide track 65 during use of the device 60. As shown in FIGS. 15 and 15A, extension 33 of spring gate 30 rests in groove 77 of top section 63, and a corresponding groove 78 on the rear side of top section 63 receives extension 34 as well.

Figure 13:
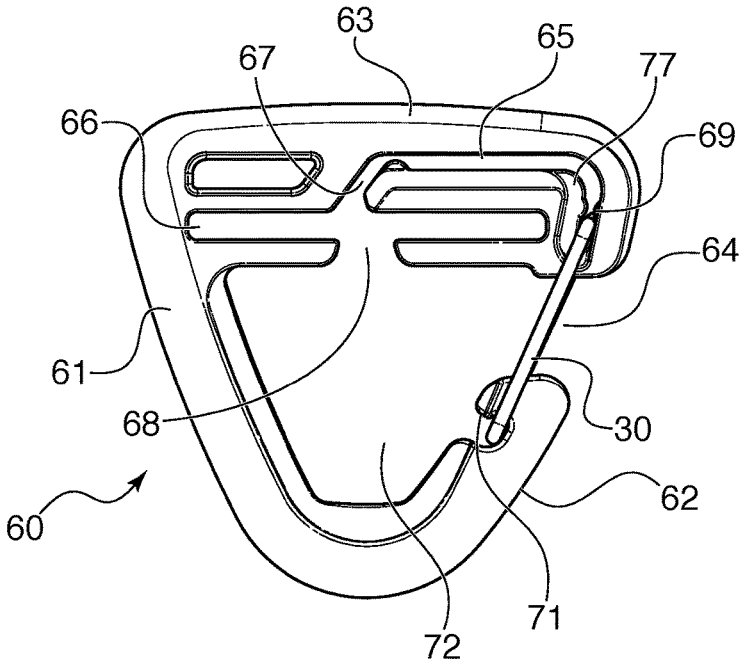
FIG. 13 shows a first alternative embodiment of the invention.
Figure 14:
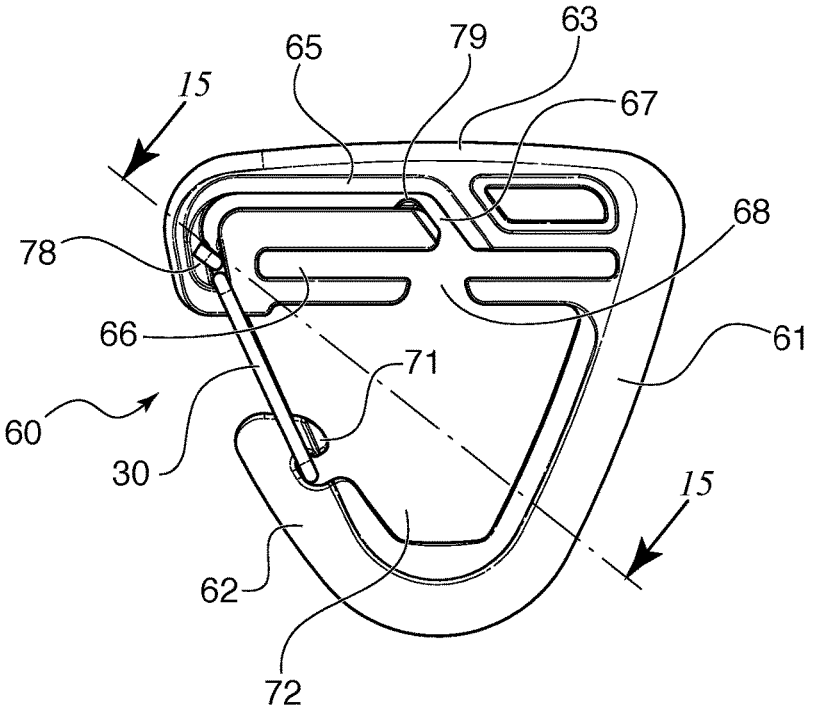
FIG. 14 shows an opposite side view of the embodiment of FIG. 13.

In a resting state, spring gate 30 rests in hook 71 to keep spring gate 30 in place, as shown in FIGS. 13 and 14. In the locked position, the extensions 33, 34 of spring gate 30 are pressed firmly against top section 63 within grooves 77 and 78, which creates a spring tension forcing spring gate 30 into hook 71 to close gap 64. As shown in FIG. 16, the interior cavity 72 can be accessed by pressing inward on spring gate 30 to overcome the spring force created by extensions 33, 34 against the grooves 77, 78 in the top section 63. When access is no longer needed, spring gate 30 swings back naturally into the locked position.

In use such as shown in FIG. 17, strap 80 is placed in slot 66, and another article 85, such as a hook, is attached to the bottom of device 60. Stress in opposite directions, caused by pulling on strap 80 in one direction and on article 85 in an opposite direction, causes guide track 65 to compress, pulling top section upwards, and more tightly seating spring gate 30 in hook 71. An additional protrusion 79 is disposed in top section 63 extending into guide track 65 near guide slot 67 in order to prevent excessive deformation of top section 63 under large stresses.

Figure 18:
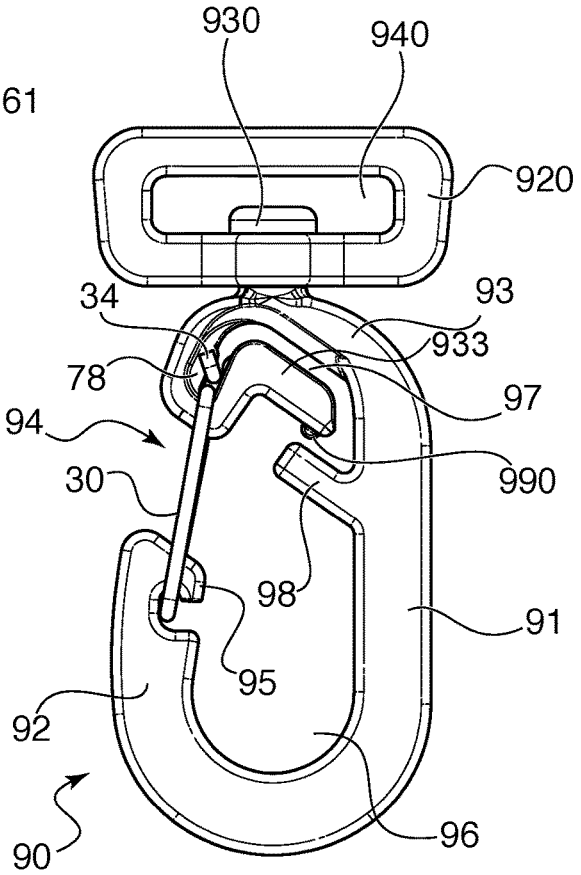
FIG. 18 shows a second alternative embodiment of the invention.
Figure 19:
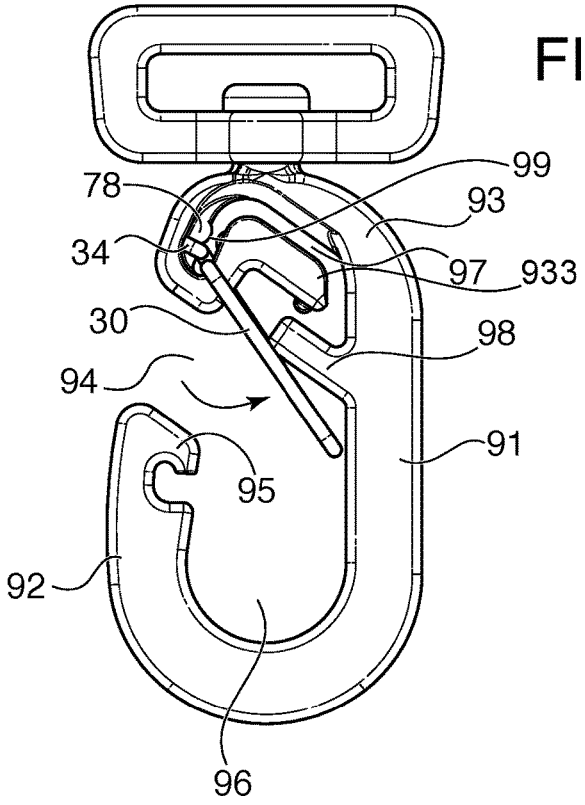
FIG. 19 shows the embodiment of FIG. 18 in an open position.
Figure 20:
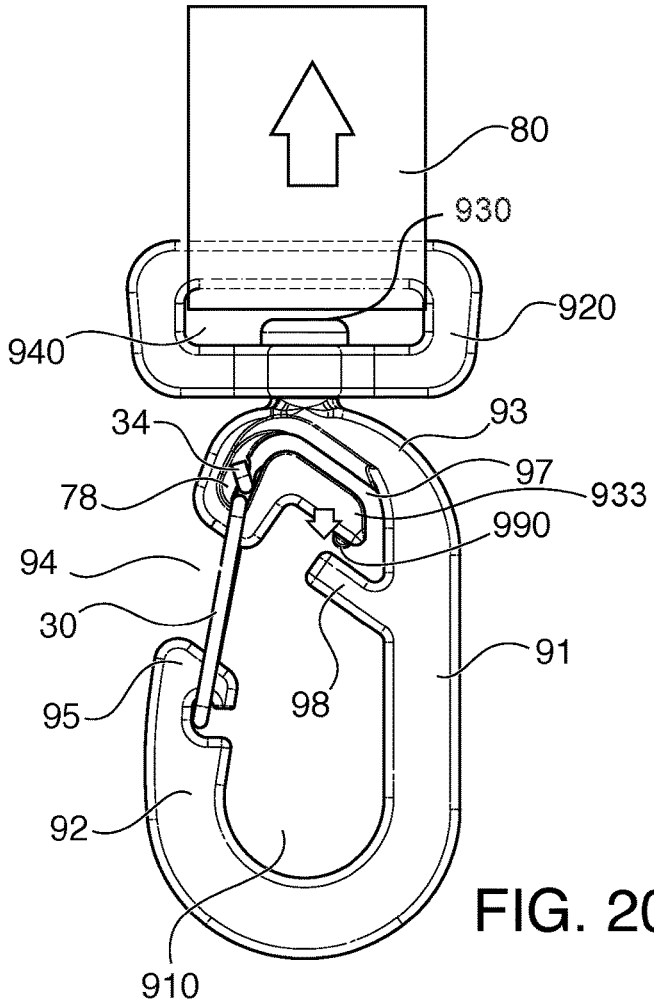
FIG. 20 shows the embodiment of FIG. 18 with a strap attached.

A further embodiment of the invention is shown in FIGS. 18-20. Here, instead of a triangular shaped ring, the device 90 is in the form of a carabiner clip. Device 90 has a first side wall 91, a second side wall 92 and a top section 93 that is spaced from the second side wall 92 by a gap 94. A hook 95 is located at the distal end of second side wall 92 adjacent gap 94. Hook 95 faces the interior 96 of device 90. A guide track 97 is located in top section 93 and extends in a curved manner following the contour of top section 93, toward first side wall 91. Guide track 93 bends around and along top bar 933 and opens into interior 96 at the end point of support wall 98, which extends inward from first side wall 91.

As with the embodiments in FIGS. 1-12 and 13-17, a spring gate 30, which is identical to the gate 30 of those embodiments, is disposed in guide track 97, and is spring loaded to be pressed into hook 95 to maintain device 90 in a closed position. The extensions 33, 34 of spring gate 30 press against grooves 77, 78 as with the embodiment in FIGS. 13-17 to press the spring gate outwardly, so that it is pressed into the locked position against hook 95. To open the gap 94, the user presses spring gate 30 inward with a force sufficient to overcome the outward spring force as shown in FIG. 19, so as to allow an article to be clipped to device 90. When the article is in position, the user simply releases spring gate 30 and it moves back to the locked position shown in FIG. 20.

As with the embodiments of FIGS. 1-12 and 13-17, device 90 is also equipped with a protrusion 99 on the distal end of guide track 97, to keep spring gate in position at the distal end. Additional protrusions could also be supplied for extra security. A further protrusion 990 is disposed at the proximal end of guide track 97 to prevent excess deformation of the parts under stress from an article (not shown) clipped to the device 90, or from strap 80, similar to the protrusions shown in the embodiments of FIGS. 1-12 and 13-17.

To secure strap 80 to device 90, a strap securing device 920 is pivotably attached to device 90 via a post 930 which is connected to top section 93. Strap securing device 920 is in the form of an open rectangle with a strap receiving slot 940. Other types of devices and shapes could also be used.

The present invention provides a simple and secure way to provide a closure system in which the spring gate is resistant to deformation even under large loads.

Accordingly, while only a few embodiments of the present invention have been shown and described, it is obvious that many changes and modifications may be made thereunto without departing from the spirit and scope of the invention.

What is claimed is:

1. A securing device comprising:

a main body having a first side wall and a second side wall, a top section connected to the main body at the first side wall, and wherein a gap is formed between a distal end of the top section and the second side wall, wherein the top section has a guide track extending longitudinally therethrough, the guide track having an opening to a space outside the top section;

a hook formed on the second side wall facing the first side wall, a spring gate in the shape of a loop with overlapping end portions, the spring gate being configured to be assembled with the main body by inserting the spring gate in the guide track and sliding the spring gate to the distal end of the guide track, wherein the spring gate is configured to press into the hook in a resting position to close the gap between the second side wall and the top section, and wherein the gap is opened by pressing the spring gate inward to release the spring gate from the hook.

2. The securing device according to claim 1, wherein the top section further comprises a slot for receiving a strap, wherein the slot has an opening to a space between the side walls.

3. The securing device according to claim 2, wherein the guide track connects to the slot at an oblique angle to a longitudinal extension of the guide track.

4. The securing device according to claim 2, further comprising a strap extending through the slot and around the top section, wherein tension on the strap away from the main body presses the strap against the top section and compresses the guide track.

5. The securing device according to claim 1, wherein there is at least one protrusion extending into the guide track at the distal end of the guide track to keep the spring gate at the distal end of the guide track.

6. The securing device according to claim 5, further comprising a reinforcing protrusion extending into the guide track at an opposite end of the guide track from said at least one protrusion.

7. The securing device according to claim 1, wherein the end portions of the spring gate have extensions that extend perpendicular to a circumferential direction of the spring gate and in opposite directions to each other.

8. The securing device according to claim 7, wherein the top section contains grooves in communication with the guide track, the grooves being configured to receive the extensions of the spring gate when the spring gate is positioned at the distal end of the guide track, such that force on the top section away from the main body presses the extensions deeper into the grooves to prevent the spring gate from opening.

9. The securing device according to claim 1, wherein the spring gate is formed from metal wire.

10. The securing device according to claim 1, further comprising a strap retainer pivotably connect to the top section, the strap retainer having a central slot for receiving a strap.

11. The securing device according to claim 1, wherein the guide track has a curved shape.

12. The securing device according to claim 11, wherein the guide track is formed by a top bar extending toward the first side wall and a support bar extending from the first side wall toward the gap and parallel to the top bar, and wherein a space between the top bar and the support bar opens into the guide track.

* * * * *